United States Patent [19]

Nishida et al.

[11] Patent Number: 4,646,366

[45] Date of Patent: Mar. 3, 1987

[54] HEAT RETAINING CLOTHING

[75] Inventors: Takeshi Nishida, Ibaragi; Jyunji Sano, Amagasaki; Toyokazu Nonaka, Nagahama, all of Japan

[73] Assignees: Kanebo Ltd.; Kanebo Textile, Ltd., both of Tokyo, Japan

[21] Appl. No.: 832,151

[22] Filed: Feb. 21, 1986

[30] Foreign Application Priority Data

Feb. 22, 1985 [JP] Japan ..... 60-25083[U]

[51] Int. Cl.[4] ..... A41D 1/02; A41D 1/00; A41D 13/00; A47C 27/08

[52] U.S. Cl. ..... 2/108; 2/93; 2/2; 2/DIG. 3; 5/455; 5/450; 5/449

[58] Field of Search ..... 2/108, 93, 94, 2, 102, 2/272, DIG. 3, DIG. 10; 5/449, 450, 455; 428/90

[56] References Cited

U.S. PATENT DOCUMENTS 4,539,714 9/1985 Frahi ..... 2/93

4,547,906 10/1985 Nishida et al. ..... 2/93

*Primary Examiner*—Doris L. Troutman

*Attorney, Agent, or Firm*—Morgan & Finnegan

[57] ABSTRACT

The heat retaining clothing of the invention comprising at least one inflatable envelope which is made of a polymer film. The film has a thickness of 50 to 150 μm and an elastic modulus of extension of at least 90%.

16 Claims, 5 Drawing Figures

Fig. 1
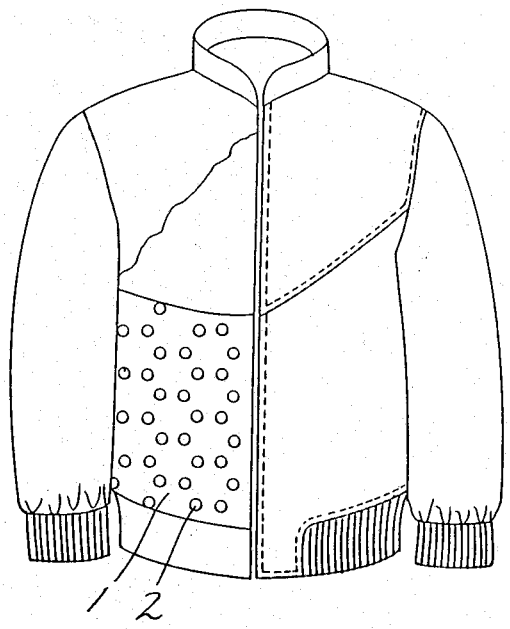
Fig. 2
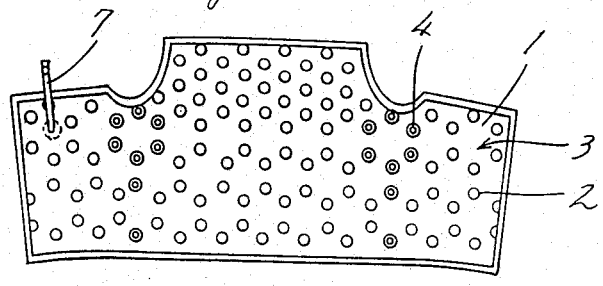
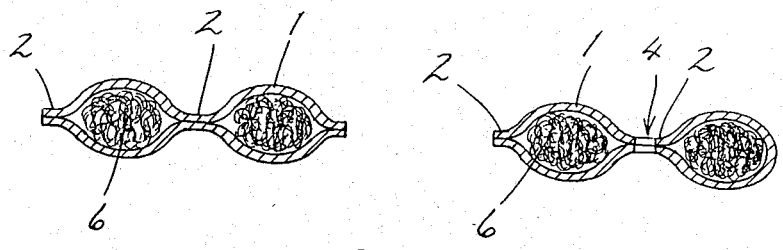
Fig. 4

HEAT RETAINING CLOTHING

BACKGROUND OF THE INVENTION

This invention relates to a heat retaining clothing produced with the use of an inflatable envelope consisting of a polymer film.

As heat retaining clothing, there have been well known quilted goods comprising wadding. Particularly, the quilted goods comprising wool or down of water birds as wadding have a heat retaining property of Clo value 1 to 4 and are generally considered to have the best heat retaining property. However, they are voluminous and inconvenient for carrying. Further, the heat retaining property can not be controlled. In view of these problems, Japanese Utility Model Publication No. 41,766 of 1980 discloses a garment in which each of body and sleeves is made by sewing together two air-impermeable sheets to form air chambers as a whole. However, because the surface and lining of the clothing do not have air-permeability, sweat of the wearer can be neither absorbed in the clothing nor evaporated, and accordingly the clothing is uncomfortable to wear. Further, the figure of the clothing is directly changed with the amount of air filled in the air chambers. The design of the clothing is limited. It is not practically used.

Thereafter, heat-retaining clothing comprising inflatable envelopes having a specific design are disclosed in Japanese Laid-Open Patent Publication No. 4,734 of 1984 and No. 4,735 of 1984 or U.S. Pat. No. 4,547,906. They are useful. However, since the inflatable envelope is made of a cloth treated with a synthetic or natural rubber and attached on a sheet material, the clothing is heavy, hard and uncomfatable to wear. Further, since the envelope is formed by sealing the edges with a high frequency welder which is applied on the cloth, the thickness of the coated material on the cloth becomes uneven. In order to obtain sufficient pressure resistance, the thickness of the coating layer on the cloth must be increased. Resultantly, the clothing becomes heavier and more uncomfortable to wear.

An object of the invention is to provide an improved heat retaining clothing comprising an inflatable envelope in which the heat retaining property can be controlled, particularly to provide a heat retaining clothing which is comfortable to wear and an improved durability for a long time.

Other objects and advantages of the invention will be apparent from the following detailed description.

SUMMARY OF THE INVENTION

The present invention is directed for a heat retaining clothing comprising at least one inflatable envelope attached to at least a part of the clothing. The inflatable envelope is made of a polymer film which has a thickness of 50 to 150 μm and an elastic modulus of extension of at least 90%.

According to the invention, since the inflatable envelope is made of a polymer film having specific properties in itself, the envelope can be easily and uniformly bonded or adhered by a high frequency welder and the like so that a light envelope having a good sealing property can be easily prepared. Further, since the envelope is superior in elastisity and has a desired tensile stress, the envelope can be stably filled with air. Resultantly, a comfortable clothing having a good heat retaining property can be prepared with the envelope.

The film used in the invention may be made of any polymer so far as satisfying the above conditions. There may be included films of natural rubber, polyurethane, polyamide, various vinyl polymers, cellulose derivatives and the like. Films made of polyurethane, polyvinyl chloride, polyvinylidene chloride, polyamide, acrylic or methacrylic resin and cellulose derivatives are preferably used, and polyurethane is most preferably used.

The shape of the envelope does never limited. However, there is preferably used an envelope such as, when the envelope is filled with air until an internal pressure of 0.05 kgf/cm$^2$, the thickness of air layer in the envelope becomes within the range of 15 mm to 60 mm, because of superior heat retaining property and shock resistance.

The envelope may be tubular or divided into plural air chambers which are connected to each other. Generally, when the envelope has a large width, it is preferred that the envelope is divided with numeral bonded portions into plural air chambers connected to each other. Particularly, there are preferred envelopes comprising bonded portions in the manner as area of each bonded portion is 4 to 80 cm$^2$, the number of the bonded portions is 30 to 400/m$^2$ based on the area of the envelope, the total area of the bonded portions is 0.1 to 0.4 m$^2$, and the relation of maximum distance L(cm) between a bonded portion and the surrounding ones to thickness T(μm) of the film and tensile strength S(kgf/cm$^2$) at 20% elongation of the film is represented by an equation of $T \times S \times 3 \rightleftarrows 1000 \geqq L$.

The "bonded portion" means a portion which can not be filled air. It may be either a portion which is wholly bonded (or sealed) or a portion in which only the circumference is bonded and the center is not bonded.

When the area of the bonded portion is too large, the wearability and the heat retaining property of the product are lowered. Further, when the distance between the bonded portions becomes larger and does not satisfy the equation as described above, shock resistance of the product in use becomes too low to obtain a desired heat retaining property.

Additionally, although the shape of the bonded portions does not limited, there are preferred that the periphery of the bonded portions does not have an angle of straight or more and that the distance between the outside projected ends of a bonded portion and the neighboring ones is 8 times or less the radius of curvature of the end. When the relation of distance (l) between the ends to radius of curvature (r) of the ends does not satisfy the equation of $l \leqq 8r$, the envelope becomes poor in pressure resistance so that a durable product can not be obtained. Further, it is preferred to make the length of the bonded portion less than 40 cm. The bonded portions may comprise a perforation in the center to improve air-permeability and the like.

On the other hand, the width of tubular envelopes is preferably within the range of 20 mm to 100 mm when air is not blown. Further, it is preferred that tubular envelope is attached to clothing such that, when the envelope is filled with air, a portion of the envelope which does not face the lining is substantially plain but the the portion of the envelope which faces the lining projects outwardy.

The envelopes may comprises a wadding material therein to prevent the enclosed air from moving and to make the heat retaining property more effective. It is preferred that a wadding material is contained in an amount of 20 to 200 g/m$^2$ based on the area of the envelope. As wadding materials, there may be used usual ones, but a dry non-woven fabric or the similar wadding material, or a foamed polymer is preferably used. Wadding materials prepared by partially bonding short fibers with such as span-bonding method, resin-spraying method, needle punching method and the like are most preferably used.

BRIEF DESCRIPTION OF THE DRAWING

The invention will be further described with reference to the accompanying drawings.

FIG. 1 is a perspective view of a jacket according to the invention.

FIG. 2 is a plan view of envelope used in the jacket shown in FIG. 1.

FIG. 4 is a sectional view of envelopes used in the invention.

DETAILED DESCRIPTION OF THE PREFERRED EMBODIMENTS

Figure 3:
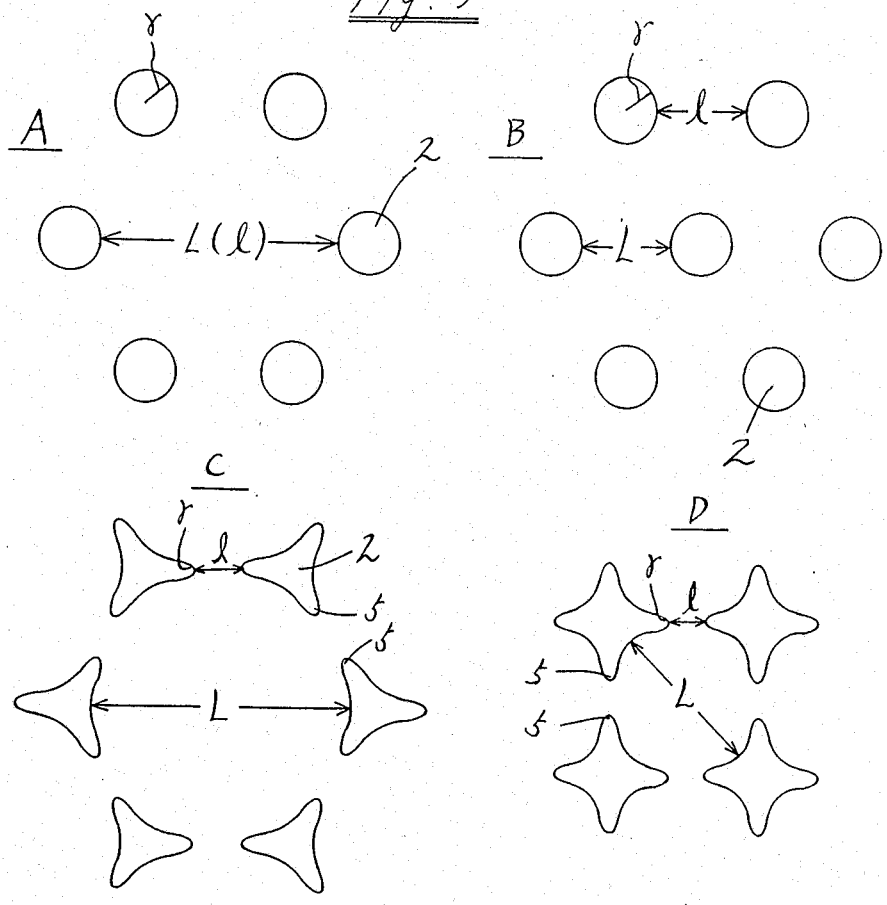
FIG. 3 is illustrations of several bonded portions which are distributed in the envelope used in the invention.

As to the envelope (1) divided with numeral bonded portions (2) into plural air chambers (3) connected to each other, the figure and distributing manner of typical bonded portions (2) are shown in FIG. 3. In FIG. 3(A), substantially circular bonded portions (2) are distributed in such manner as each bonded portion (2) is located at the apex of an equilateral hexagon. In FIG. 3(B), substantially circular bonded portions (2) are distributed in such manner as each bonded portion (2) is located at the apex of an equilateral triangle. In FIG. 3(C), substantially triangular bonded portions (2) are distributed in such manner as each bonded portion (2) is located at the apex of an equilateral hexagon. In FIG. 3(D), substantially cross-shaped bonded portions (2) are distributed in such manner as each bonded portion (2) is located at the apex of a regular square.

Accoding to the invention, such tubular envelopes (1) as shown in FIG. 4 may be used. The tubular envelope (1) may be attached in a continuous zig-zag form on the whole body over the side of clothing. In this case, it is preferred that at least bending portion (8) of the tubular envelope is fixed on the lining (9) of the clothing as shown FIG. 5.

Wadding materials (6) may be comprise in each of envelopes as shown in FIG. 2 and FIG. 4. The wadding materials (6) are useful not only to make the heat retaining property more effective but also to prevent the adhesion of films of the envelope's material.

Figure 5:
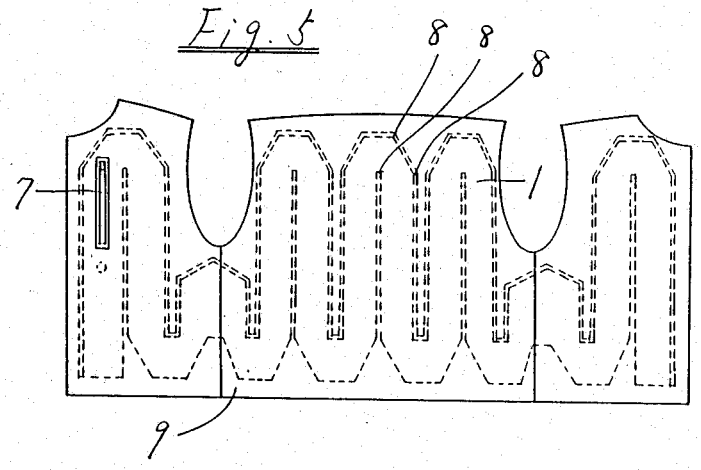
FIG. 5 is a plan view of a main part of a jacket pattern according to the invention.

The envelopes (1) have at least one air inlet (7) as shown in FIG. 2 and FIG. 5. The amount of air inside the envelope is controlled through the air inlet (7) to get a desired heat retaining property.

The envelope (1) may be attached to at least a part of clothing, such as body, sleeve and the like, and may be attached with sewing or welding or bonding with a bonding material the edges or bonded portions (2) on the surface cloth or lining of clothing. Alternatively, the envelope (1) is attached to a sheet material and the sheet material may be attached to the clothing.

As clothing according to the invention, there are included upperwear such as jackets, working clothes, trousers, coats and the like, underwear, innerwear and other various apparels.

The following examples serve to illustrate the invention in more detail although the invention is not limited to the examples.

EXAMPLE 1

A jacket according to the invention is shown in FIGS. 1. In this case, envelopes (1) having a shape corresponding to front body and back body of the jacket, as shown FIG. 2, was prepared with polyurethane films and polyvinyl chloride films as shown in Table 1 and attached to the lining of the jacket.

Envelopes A-1 and A-2 had cercular bonded portions (2) having a diameter of 3 cm which were distributed in such manner as each bonded portion (2) was located at the the apex of an equilateral triangle having a lateral of 6 cm. Envelopes B-1 to B-14 had cercular bonded portions (2) having a diameter of 3 cm which were distributed in such manner as each bonded portion (2) was located at the apex of an equilateral hexagon having a lateral of 6 cm. Air chambers (3) which were divided by the bonded portions (2) but connected to each other in the whole were formed in each envelope. The bonded portions (2) located at the side of the chest had a circular perforation (4) having a diameter of 1.5 cm in the center so as to make the air permeability and moisture permeability better.

With naturally blowing air by mouth in the envelopes (1), the internal pressure became about 0.05 kgf/cm$^2$. However, with strongly blowing air by a young man, the internal pressure was increased to 0.08 kgf/cm$^2$ to 0.12 kgf/cm$^2$. Accordingly, it is understood that it is necessary for the envelopes to resist an internal pressure of 0.12 kgf/cm$^2$.

The properties of the used films and the products are shown in Table 1. From the results, it is understood that a thickness of film should be at least 50 $\mu$m, and 70 $\mu$m or more is preferable.

On the other hand, since polyurethane films and polyvinyl chloride films generally have a tensile strength of at least 150 kgf/cm$^2$ and an elongation of at least 300%, the films having such thickness and elastic modurus of extension as defined in the invention can produce an envelope having a desired pressure resistance (0.12 kgf/cm$^2$).

In point of wearability, an internal pressure of 0.02 kgf/cm$^2$ to 0.05 kgf/cm$^2$ is preferred. In the envelope having such internal pressure, the internal pressure is momentarily increased to 0.07 kgf/cm$^2$ to 0.11 kgf/cm$^2$ by giving a shock such as lying down, but the envelope made of a film having an elastic modurus of extension of at least 90% resists the shock.

TABLE 1

| Envelope*1 No. | Kind of film | Film thickness T (μm) | Tensile strength at 20% elongation S (kgf/cm²) | $\frac{T \times S \times 3}{1000}$ | Extension modurus of elastisity (%) | Shock resistance | Maximum value of internal pressure (kgf/cm²) | Weight (g) | Wear-ability | Total*2 evaluation |
|---|---|---|---|---|---|---|---|---|---|---|
| A-1 | Urethane | 40 | 60 | 7.2 | 93 | 90 | 0.11 | 60 | Very good | X (2-1) |
| A-2 | " | 50 | 50 | 7.5 | 95 | 100< | 0.2< | 74 | Very good | O |
| B-1 | " | 40 | 60 | 7.2 | 93 | 50 | 0.09 | 60 | Very good | X (2-1) |
| B-2 | " | 50 | 50 | 7.5 | 95 | 90 | 0.10 | 74 | Very good | X (2-1) |
| B-3 | " | 50 | 60 | 9.0 | 93 | 100< | 0.12 | 76 | Very good | O |
| B-4 | " | 75 | 50 | 11.3 | 95 | 100< | 0.14 | 109 | Very good | O |
| B-5 | " | 100 | 47 | 14.1 | 95 | 100< | 0.18 | 150 | Good | O |
| B-6 | " | 150 | 47 | 21.1 | 95 | 100< | 0.2< | 220 | Good | O |
| B-7 | " | 200 | 46 | 27.6 | 95 | 100< | 0.2< | 294 | Bad | X (2-2) |
| B-8 | " | 100 | 33 | 9.9 | 96 | 100< | 0.12 | 148 | Good | O |
| B-9 | " | 90 | 33 | 8.9 | 96 | 100< | 0.11 | 134 | Good | X (2-1) |
| B-10 | " | 150 | 14.4 | 7.2 | 97 | 73 | 0.09 | 224 | Good | X (2-1) |
| B-11 | " | 200 | 15 | 9.0 | 97 | 100< | 0.12 | 298 | Bad | X (2-2) |
| B-12 | PVC | 150 | 20 | 9.0 | 94 | 100< | 0.12 | 232 | Good | O |
| B-13 | " | 100 | 43 | 12.9 | 85 | 60 | 0.14 | 165 | Bad | X (2-3) |
| B-14 | " | 110 | 27 | 8.9 | 88 | 75 | 0.11 | 183 | Bad | X (2-4) |

*1 1. Envelopes A-1 and A-2 have curcular bonded portions having a diameter of 3 cm which are distributed in such manner as each bonded portion is located at the apex of an equilateral triangle having a lateral of 6 cm (the maximum distance between the outside ends of bonded portions L = 3 cm).
2. Envelopes B-1 to B-14 have curcular bonded portions having a diameter of 3 cm which are distributed in such manner as each bonded portion is located at the apex of an equilateral hexagon having a lateral of 6 cm (the maximum distance between the outside ends of bonded portions L = 9 cm).
3. The area of each bonded portion is 7 cm².
*2 2-1 means that the envelope does not have a sufficient pressure resistance.
2-2 means that the envelope is heavy and hard.
2-3 means that the envelope is poor in shock resistance and hard.
2-4 means that the envelope does not have a sufficient pressure resistance and is hard.

As shown in Table 1, the envelopes A-1 and B-1 in which films have a thickness of less than 50 μm and the envelopes B-1, B-2, B-9, B-10 and B-14 in which the equation of $T \times S \times 3 \div 1000 \geqq L$ is not satisfied are poor in pressure resistance and can not produce a heat retaining property desired in clothing. The envelopes B-13 and B-14 in which films have an elastic modurus of extension of less than 90% and the envelopes B-7 and B-11 in which films have a thickness of more than 150 μm can not produce a comfortable clothing. On the other hand, with the use of the envelopes A-2, B-3 to B-6, B-8 and B-12 according to the invention, there can be obtained clothing comfortable and superior in heat retaining property.

Further, as to the relationship between the internal pressure of envelopes (1) and the heat retaining property, it is preferable to increase the internal pressure and the thickness of air layer. Generally, when the thickness of air layer is less than 15 mm, desired heat retaining property can not be obtained, but the heat retaining property corresponding to down can be obtained by increasing the internal pressure to 0.05 kgf/cm² as shown in Table 2.

TABLE 2

| Envelope No. | Internal pressure (kgf/cm²) | Thickness of air layer (mm) | Hear retaining property (Clo value) |
|---|---|---|---|
| 1 | 0.05 | 48 | 1.8 |
| 1 | 0.1 | 53 | 2.0 |
| 2 | 0.05 | 22 | 1.3 |
| 2 | 0.1 | 25 | 1.4 |
| Jacket comprising 200 g of down. | | | 2.0 |
| Jacket comprising 120 g of down. | | | 1.4 |

Note:
Envelope No. 1 has curcular bonded portions having diameter of 3 mm which are distributed in such manner as each bonded portion is located at the apex of an equilateral hexagon having a lateral of 6 cm.
Envelope No. 2 has curcular bonded portions having a diameter of 3 mm which are distributed in such manner as each bonded portion is located at the apex of an equilateral triangle having a lateral of 6 cm.

The properties shown in Tables 1 and 2 were examined by the following methods.

Heat Retaining Property

An envelope sample of 40 cm squere was made, the envelope was entered into an envelope prepared by sewing a polyester taffeta coated with a resin to a cotton fabric. The heat retaining property of the sample was measured with a testing machine manufactured according to ASTM D-1513-57T.

Elastic Modurus of Extension

It was examined according to JIS L 10 cotton textile testing method.

Shock Resistance

The envelope sample was filled with air until an internal pressure of 0.05 kgf/cm², and then the inflated envelope was pressed by hand to increase the internal pressure to 0.11 kgf/cm². The pressing was repeated and the number of times of pressing until the envelope was broken was counted.

Maximum Value of Internal Pressure

When increasing the internal pressure by blowing air in the envelope was stopped, the internal pressure was measured.

Wearability

Jacket comprising the envelope was weared, and the envelope was filled with air until an internal pressure of 0.05 kgf/cm. The wearability was examined.

EXAMPLE 2

Seven envelopes which had different bonded portions (2) as shown in FIG. 3 were made of polyurethane film having a thickness of 80 μm, a tensile strength of 500 kgf/cm² at an elongation of 20% and an elastic modulus of extension of 94%. The mximum value of internal pressure of them was examined. The results are shown in Table 3.

It is understood from the data of Table 3 that, when a pressure resistance of at least 0.12 kgf/cm² is required, the distance (l) between outside projected ends (5) of one bonded portion (2) and the neighboring bonded portions (2) must be 8 times or less the radius (r) of curvature of the ends (5).

TABLE 3

| Envelope No. | Radius of curvature r (cm) | Distance between outside projected ends l (cm) | Ratio of l/r | Maximum value of internal pressure (kgf/cm$^2$) | Area of each bonded portion (cm$^2$) |
|---|---|---|---|---|---|
| A-1 | 1.5 | 9 | 6 | 0.14 | 7 |
| A-2 | 1.0 | 10 | 10 | 0.10 | 3 |
| B-1 | 1.5 | 3 | 2 | 0.2< | 7 |
| C-1 | 0.3 | 1.2 | 4 | 0.14 | 7 |
| C-2 | 0.3 | 2.7 | 9 | 0.11 | 7 |
| D-1 | 0.5 | 1.2 | 2.4 | 0.13 | 30 |
| D-2 | 0.14 | 1.4 | 10 | 0.08 | 24 |

Note:
Envelopes A-1 and A-2 have such bonded portions (2) as shown in FIG. 3(A).
Envelope B-1 has such bonded portions (2) as shown in FIG. 3(B).
Envelopes C-1 and C-2 have such bonded portions (2) as shown in FIG. 3(C).
Envelopes D-1 and D-2 have such bonded portions (2) as shown in FIG. 3(D).

What we claim is:

1. Heat retaining clothing comprising at least one inflatable envelope attached to at least a part of the clothing, characterized in that said inflatable envelope is made of a polymer film, said film having a thickness of 50 to 150 μm and an elastic modulus of extension of at least 90%.

2. Heat retaining clothing as defined in claim 1, wherein said envelope is made of a polyurethane film.

3. Heat retaining clothing as defined in claim, wherein by filling said envelope with air until an internal pressure of 0.05 kgf/cm$^2$, the thickness of air layer in said envelope becomes within the range of 15 mm to 60 mm.

4. Heat retaining clothing as defined in claim 1, wherein said envelope is divided with numeral bonded portions into plural air chambers connected to each other, the area of each bonded portion is 4 to 80 cm$^2$, the number of the bonded portions is 30 to 400/m$^2$ based on the area of said envelope, the total area of the bonded portions is 0.1 to 0.4 m$^2$, and the relation of maximum distance L(cm) between a bonded portion and the surrounding ones to thickness T(μm) of the film and tensile strength S(kgf/cm$^2$) at 20% elongation of the film is represented by the equation of $T \times S \times 3 \div 1000 \geqq L$.

5. Heat retaining clothing as defined in claim 4, wherein the periphery of said bonded portions does not have an angle of straight or more and the distance between the outside projcted ends of one bonded portion and the neighboring ones is 8 times the radius of curvature of said end or less.

6. Heat retaining clothing as defined in claim 4, wherein a wadding material is contained in said envelope in an amount of 20 to 200 g/m$^2$ based on the area of the envelope.

7. Heat retaining clothing as defined in claim 6, wherein said wadding material comprises a dry nonwoven fabric or the similar wadding material, or a foamed polymer.

8. Heat retaining clothing as defined in claim 4, wherein at least a part of said bonded portions has a perforation part in the centre.

9. Heat retaining clothing as defined in claim 4, wherein the muximum length of said bonded portion is 40 cm or less.

10. Heat retaining clothing as defined in claim 4, wherein said bonded portions are substantially circular and distributed in such manner as each bonded portion is located at the apex of an equilateral triangle or an equilateral hexagon.

11. Heat retaining clothing as defined in claim 4, wherein said bonded portions are substantially cross-shaped and distributed in such manner as each bonded portion is located at the apex of a regular square.

12. Heat retaining clothing as defined in claim 4, wherein said bonded portions are substantially triangular and distributed in such manner as each bonded portion is located at the apex of an equilateral hexagon.

13. Heat retaining clothing as defined in claim 1, wherein said envelope is tubular.

14. Heat retaining clothing as defined in claim 13, wherein said tubular envelope is attached in a continuous zig-zag form on the whole body over the side of the clothing and at least the bending portion of said tubular envelope is fixed on the lining of the clothing.

15. Heat retaining clothing as defined in claim 13, wherein said envelope is attached to the clothing such that, when said envelope is filled with air, a portion of said envelope which does not face the lining is substantially plain but the the portion of said envelope which faces the lining projects outwardy.

16. Heat retaining clothing as defined in anyone of claims 13, wherein the width of the tubular envelope when it is not filled with air is 20 to 100 mm.

* * * * *